United States Patent [19]

Kawata et al.

[11] Patent Number: 4,606,991

[45] Date of Patent: Aug. 19, 1986

[54] COLOR PHOTOGRAPHIC LIGHT-SENSITIVE MATERIAL WITH 2-ACYLAMINO PHENOL DYE RELEASER

[75] Inventors: Ken Kawata; Kozo Sato; Hideki Naito, all of Kanagawa, Japan

[73] Assignee: Fuji Photo Film Co., Ltd., Kanagawa, Japan

[21] Appl. No.: 766,314

[22] Filed: Aug. 16, 1985

[30] Foreign Application Priority Data

Aug. 17, 1984 [JP] Japan ..... 59-171162

[51] Int. Cl.[4] ..... G03C 1/40; G03C 5/54

[52] U.S. Cl. ..... 430/203; 430/223; 430/559

[58] Field of Search ..... 430/223, 226, 559, 553, 430/203

[56] References Cited

U.S. PATENT DOCUMENTS

| | | | |
|---|---|---|---|
| 4,076,529 | 2/1978 | Fleckenstein et al. | 430/223 |
| 4,258,120 | 3/1981 | Gerbal et al. | 430/223 |
| 4,439,513 | 3/1984 | Sato et al. | 430/223 |
| 4,483,914 | 11/1984 | Naito et al. | 430/226 |

*Primary Examiner*—Richard L. Schilling

*Attorney, Agent, or Firm*—Sughrue, Mion, Zinn, Macpeak & Seas

[57] ABSTRACT

A color photographic light-sensitive material is described, comprising at least one of a dye-providing 2-acylaminophenol derivative represented by the formula A-L-D, wherein A is a reducing group, L is a bonding group, and D is an image forming dye or dye precursor group.

6 Claims, No Drawings

COLOR PHOTOGRAPHIC LIGHT-SENSITIVE MATERIAL WITH 2-ACYLAMINO PHENOL DYE RELEASER

FIELD OF THE INVENTION

The present invention relates to a dye-providing substances for color photographic light-sensitive materials. In more detail, it relates to reducing compounds which release a diffusible dye by an oxidation-reduction reaction with silver halide and/or an organic silver salt compound.

BACKGROUND OF THE INVENTION

Many processes are known for formation of color images by transfer or diffusible dyes. For example, U.S. Pat. No. 3,134,764 discloses a process using a dye developing agent in which a hydroquinone developing agent is bonded with a dye. Japanese Patent Application (OPI) No. 63618/76 discloses a process which comprises releasing a diffusible dye by an intramolecular ester interchange reaction, and Japanese Patent Application (OPI) No. 111628/74 discloses a process which comprises releasing a diffusible dye by an intramolecular rearrangement reaction of a isooxazolone ring. All of these processes are those wherein the dye is diffused into an image receiving layer in parts where development does not take place (nonexposed parts), and release or diffusion of the dye does not take place in parts where development is carried out (exposed parts). However, these processes have a fault in that it is very difficult to obtain an image having a high ratio of S/N (signal/noise), because the development is carried out simultaneously with the release or diffusion of the dye. In order to overcome this fault, a process wherein a coloring material which is provided in an oxidized state having no ability to release a dye is allowed to coexist with a reducing agent precursor, and a diffusible dye is released by reduction with a reducing agent remaining without oxidation after development, is described in Japanese Patent Application (OPI) No. 110827/78. However, this process has a fault in that an image having a high ratio of S/N is not obtained if the development rate and the reduction rate of the coloring material by the reducing agent are not strictly controlled.

On the other hand, as a process wherein a diffusible dye is released in the part where development is carried out, a process which comprises releasing a diffusible dye by a reaction between a coupler having a diffusible dye in a releasing group and an oxidized product of a color developing agent is described in British Pat. No. 1,330,524, and a process which comprises forming a diffusible dye by a reaction between a coupler having an antidiffusible group in the releasing group and an oxidized product of a color developing agent is described in U.S. Pat. No. 3,227,550. However, in these processes using a color developing agent, staining of the image by the oxidized product of the developing agent causes serious trouble.

As reducing dye-providing substances which have a similar function with compounds of the present invention, the following compounds (1) to (12), etc., have been known.

(1)

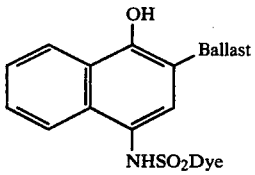

U.S. Pat. No. 3,928,312, U.S. Pat. No. 3,992,638

(2)

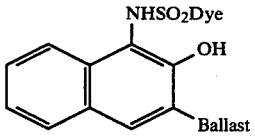

U.S. Pat. No. 4,053,312

(3)

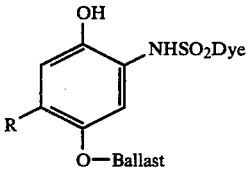

U.S. Pat. No. 4,055,428

(4)

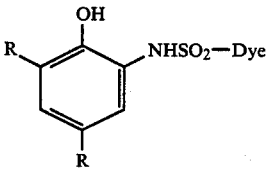

Japanese Patent Application (OPI) No. 104343/76

(5)

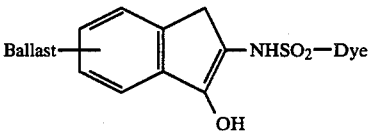

Japanese Patent Application (OPI) No. 3819/78

(6)

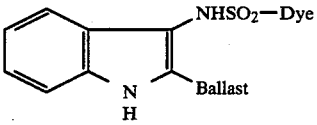

Japanese Patent Application (OPI) No. 104343/76

(7)

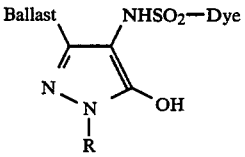

Japanese Patent Application (OPI) No. 104343/76

(8)

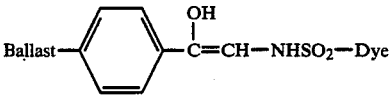

Japanese Patent Application (OPI) No. 104343/76

(9)

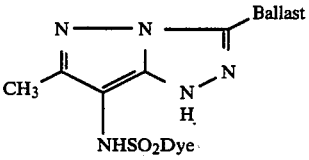

Research Disclosure, RD No. 17465 (1976)

-continued (10)

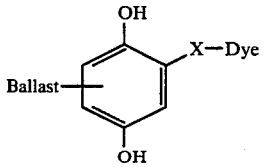

U.S. Pat. No. 3,725,062

(11)

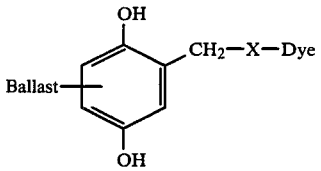

U.S. Pat. No. 3,728,113

(12)

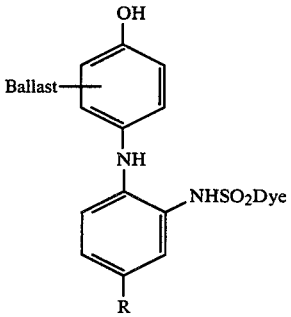

U.S. Pat. No. 3,443,939

Of these, the compounds (1) to (9) release a diffusible dye having a terminal sulfamoyl group by the function of alkali after they are oxidized by development processing. However, they require an alkali solution having a high pH as a developing solution and have a fault in that it is necessary to use a hydrophilic binder and to use an alkali solution as a diffusing assistant in order to obtain an image having high density, because the released dye has very low diffusibility in a hydrophobic binder because of the sulfamoyl group.

Further, the compounds (10) to (12) cannot be put to practical use, because efficiency in the dye releasing step after oxidation is inferior.

SUMMARY OF THE INVENTION

The present invention provides novel dye-providing substances for color light-sensitive materials, by which the faults of the prior substances can be overcome.

A first object of the present invention is to provide reducing dye-providing substances which provide high dye transfer density, as diffusion transfer coloring materials.

A second object is to provide dye-providing substances having excellent dye releasing efficiency after being oxidized.

A third object is to provide dye providing substances capable of releasing a dye having excellent diffusibility.

A fourth object is to provide dye-providing substances having excellent stability with respect to the passage of time.

Such objects can be attained by dye-providing substances represented by formula (I)

A—L—D (I)

wherein A represents a reducing group which can be oxidized with silver halide or organic silver salt compounds, D represents an image forming dye or dye precursor part, and L represents a bonding group for A and D. The reducing group A is a 2-acylaminophenol residue which is represented by formula (II).

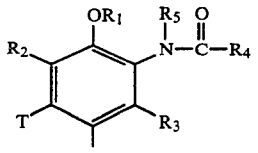

(II)

wherein $R_1$ represents a hydrogen atom or an acyl group, and $R_2$, $R_3$, $R_4$ and $R_5$ (which may be the same or different) each represents a substituent selected from a hydrogen atom, alkyl group, cycloalkyl group, alkenyl group, aryl group, alkoxy group, aryloxy group, aralkyl group, acylamino group, alkylamino group, dialkylamino group, arylamino group, diarylamino group, halogen atom, acyloxy group, hydroxyl group, carboxyl group, cyano group, acyl group, carbamoyl group, substituted carbamoyl group, sulfamoyl group, substituted sulfamoyl group, sulfamoylamino group, substituted sulfamoylamino group, ureido group, substituted ureido group, alkylsulfonyl group, arylsulfonyl group, alkylsulfonylamino group, arylsulfonylamino group, and nitro groups, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group.

T represents a substituent selected from alkoxy group, aryloxy group, alkylsulfonylamino group, arylsulfonylamino group, alkylamino group, dialkylamino group, arylamino group and diarylamino group, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group.

The bonding group L is a divalent group selected from the following.

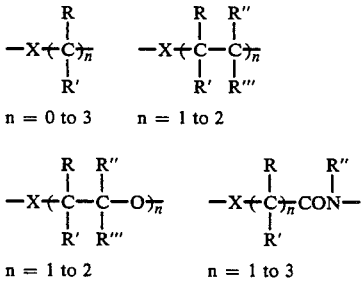

-continued

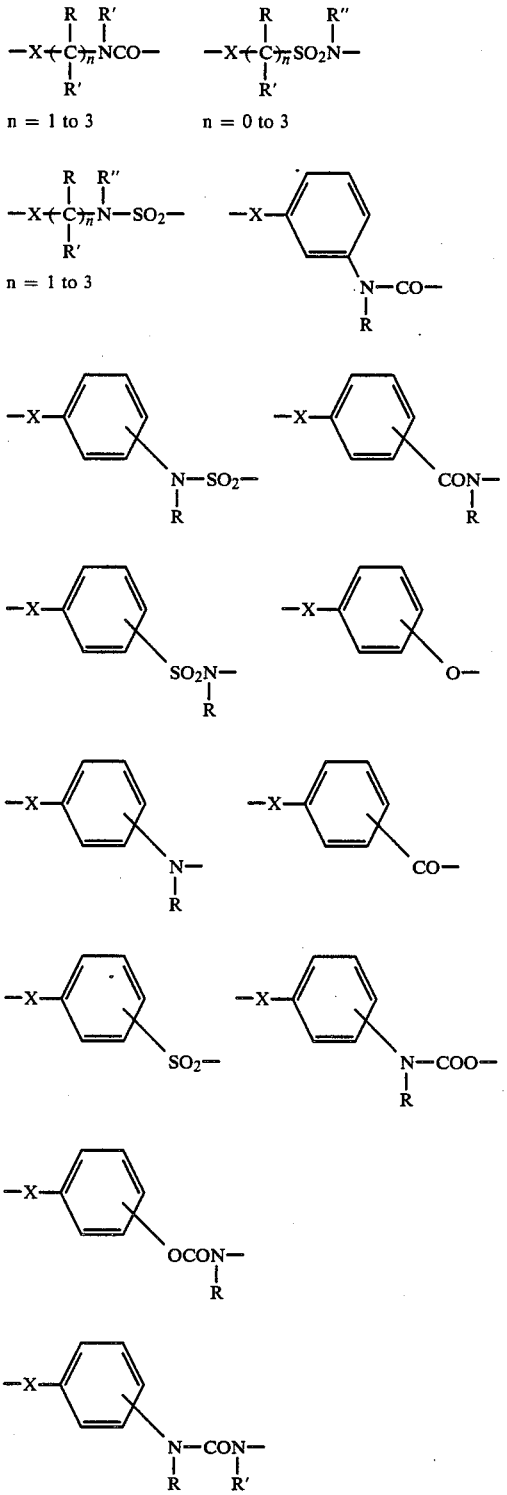

wherein R, R′, R″, and R″ each represents a substituent selected from a hydrogen atom, methyl group, ethyl group, hydroxymethyl group, methoxymethyl group, carboxymethyl group, cyanomethyl group, hyroxyethyl group, methoxyethyl group, carboxyethyl group, and cyanoethyl group; and the benzene ring of the bonding groups containing a benzene ring contain substituents selected from the group containing of a hydrogen atom, alkyl group, alkoxy group, halogen group, and hydroxyl group.

X represents —O—, —S—,

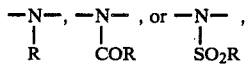

wherein R is the same as defined above.

D represents a dye or dye precursor.

DETAILED DESCRIPTION OF THE INVENTION

Preferably the reducing group A has an oxidation-reduction potential with respect to a saturated calomel electrode of 1.2 V or less measuring the polarographic half wave potential using acetonitrile as a solvent and sodium perchlorate as a base electrolyte, and has the following characteristics.

1. It is rapidly oxidized by the silver halide or organic silver salt to effectively release a diffusible dye by the function of the nucleating reagent.

2. The reducing group has a ballast group to unpassinate the dye-providing substance in the binder (the ballast group is a hydrophilic group generally having a carbon atom of 10 or more).

3. It has excellent stability to heat and to the nucleating reagent, and does not release the diffusible dye until it is oxidized.

4. It is easily synthesized.

Specific examples of preferred reducing groups are shown below.

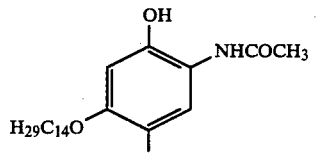

(A-1)

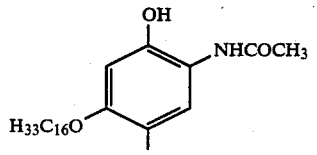

(A-2)

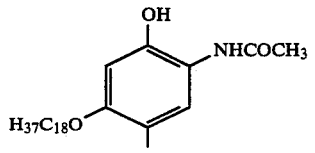

(A-3)

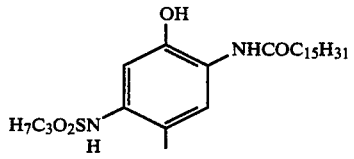

(A-4)

-continued (A-5)

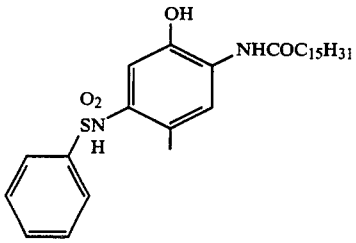

(A-6)

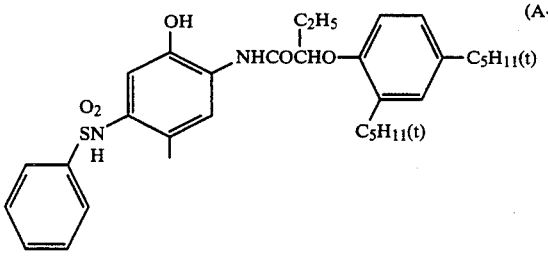

(A-7)

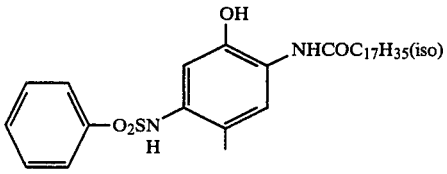

(A-8)

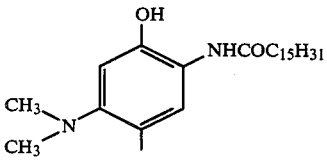

(A-9)

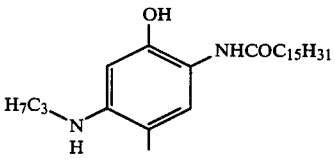

(A-10)

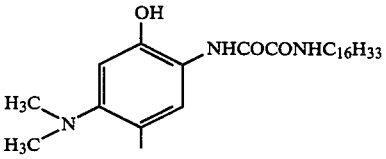

(A-11)

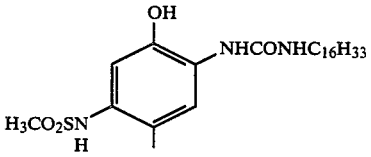

(A-12)

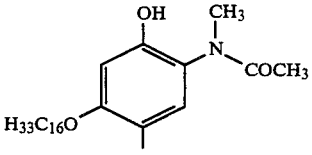

-continued (A-13)

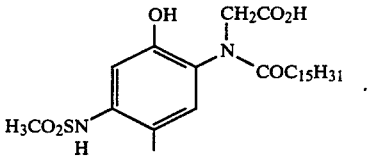

(A-14)

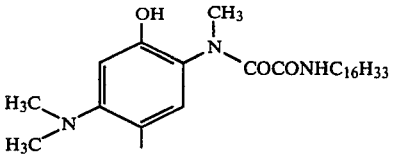

(A-15)

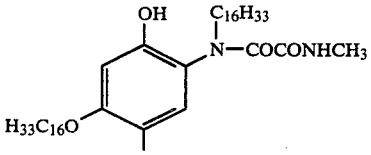

(A-16)

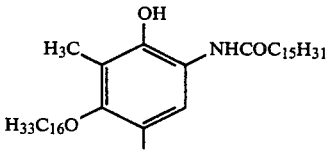

(A-17)

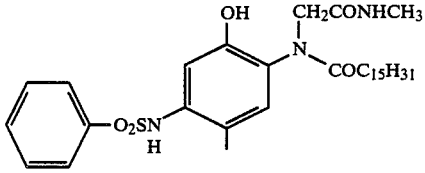

(A-18)

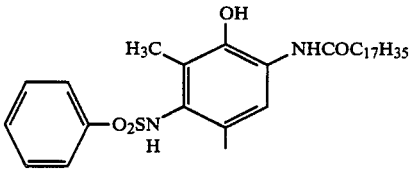

(A-19)

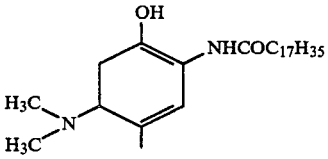

(A-20)

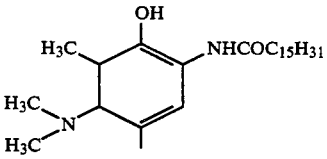

The bonding group L bonds the reducing group A and the dye portion D by a covalent bond. Simultaneously, the bonding group L greatly affects the oxidiation-reduction potential of the reducing group A and has the important role to act as a releasing group in the dye release step.

It is preferred for the bonding group L not to have a group which inhibits the diffusion of the dye. Further, the bulky bonding group which disturbs attachment of the nucleating agent to the carbon at the bonding position of A and L (i.e., the carbon at the p-position with respect to OH group in A) is not preferred. Examples of the bonding group L are the groups which connect to the reducing group A through oxygen atom and have total carbon atoms of 12 or less. Preferred examples of the bonding group L are shown below.

$-OCH_2CH_2-$ (L-1)
$-CH_2CH_2CH_2-$ (L-2)
$-OCH_2CONH-$ (L-3)
$-OCH_2CH_2CONH-$ (L-4)

$-OCH(CH_3)-$ (L-5)

$-OCH(CH_3)-CH_2-$ (L-6)

$-OCH_2-CH(CH_3)-$ (L-7)

$-OCH_2-$ (L-8)
$-OCH_2CH_2O-$ (L-9)

$-OCH(CH_3)-CH_2O-$ (L-10)

$-OCH_2-CH(CH_3)O-$ (L-11)

$-OCH(CH_3)CONH-$ (L-12)

$-OCH_2-CH(CH_3)-CONH-$ (L-13)

$-OCH_2CH_2NHCO-$ (L-14)
$-OCH_2CH_2CH_2NHCO-$ (L-15)
$-OCH_2CH_2CH_2CONH-$ (L-16)
$-OCH_2CH_2CH_2SO_2NH-$ (L-17)
$-OCH_2CH_2NHSO_2-$ (L-18)
$-OCH_2CH_2CH_2NHSO_2-$ (L-19)

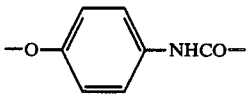
(L-20)

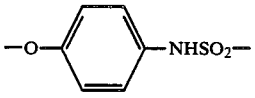
(L-21)

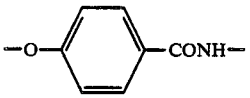
(L-22)

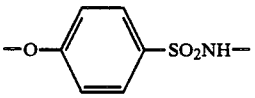
(L-23)

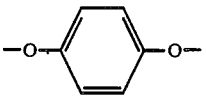
(L-24)

-continued

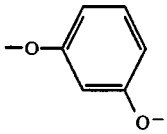
(L-25)

The bonding groups are not limited to the above examples.

Examples of dyes which can be used for image forming dye portion D include azo dyes, azomethine dyes, anthraquinone dyes, naphthoquinone dyes, styryl dyes, quinophtalone dyes, indigoid dyes, carbonium ion dyes, and phthalocyanine dyes. Representative examples thereof are set forth below and are classified by hue.

Yellow:

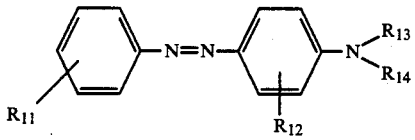

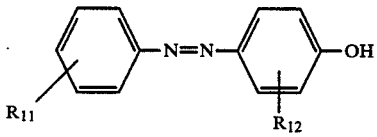

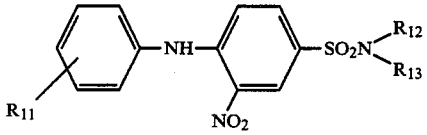

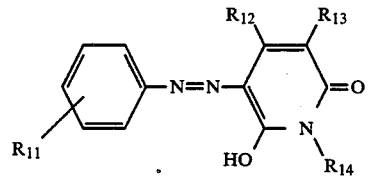

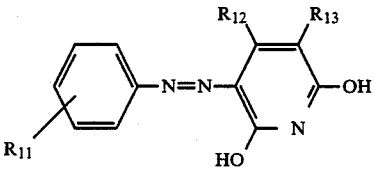

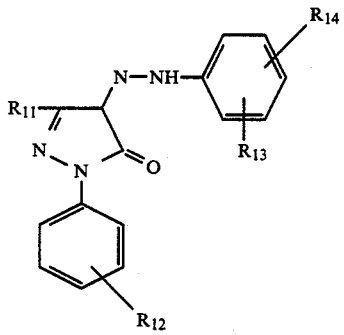

-continued
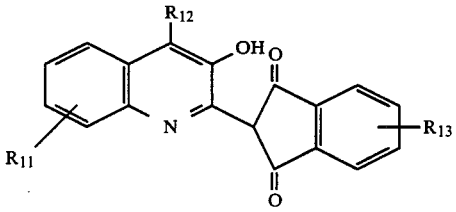
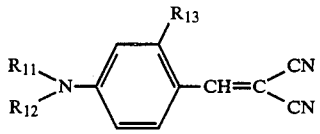
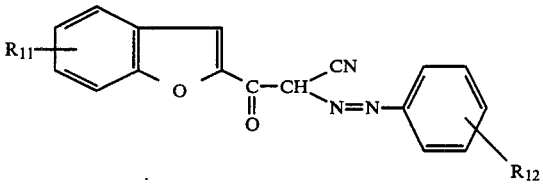
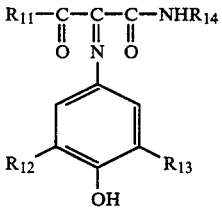
Magenta:
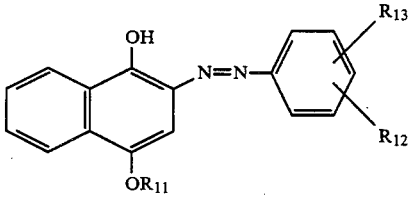
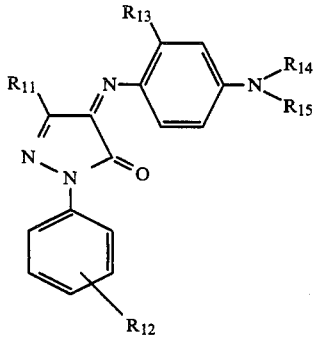
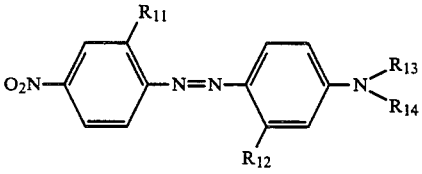
-continued
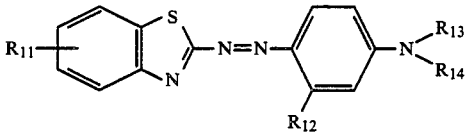
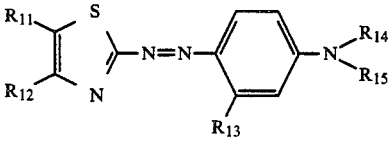
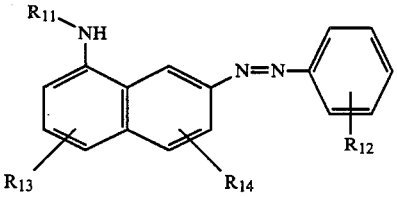
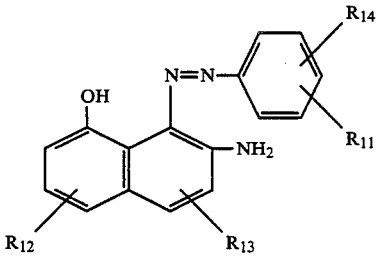
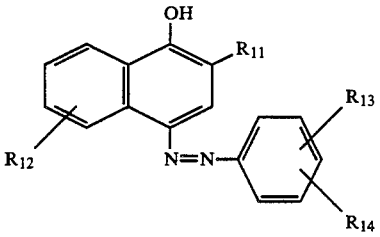
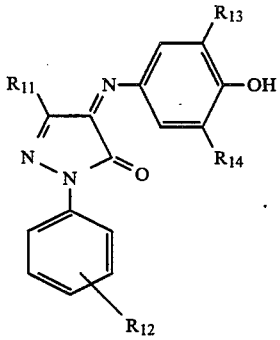
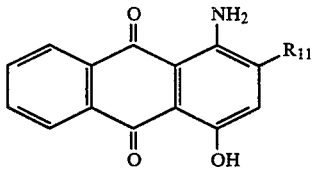

-continued
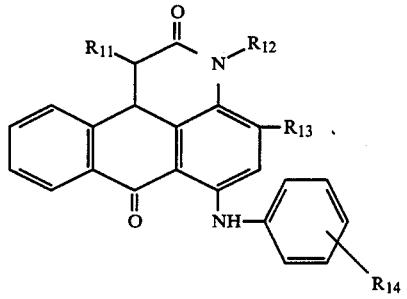
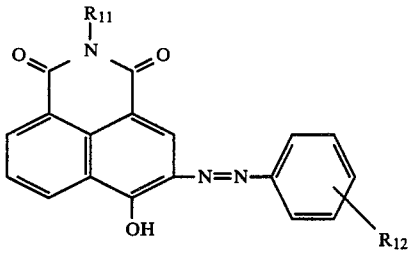
Cyan:
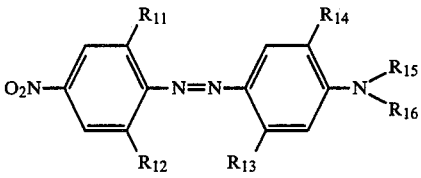
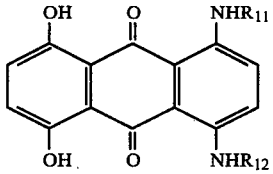
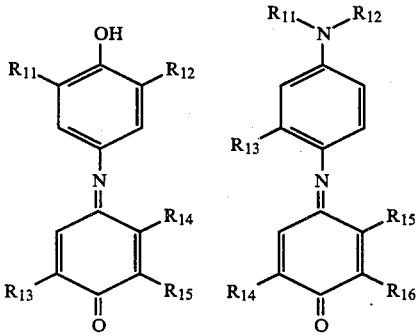
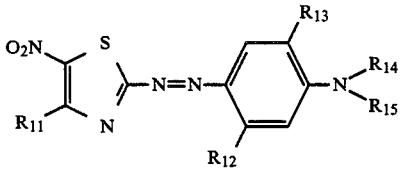
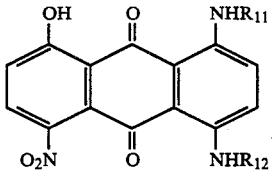
-continued
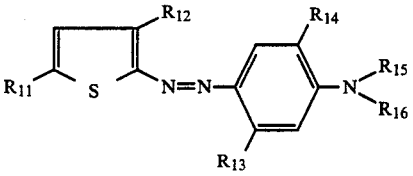
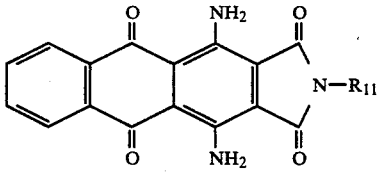
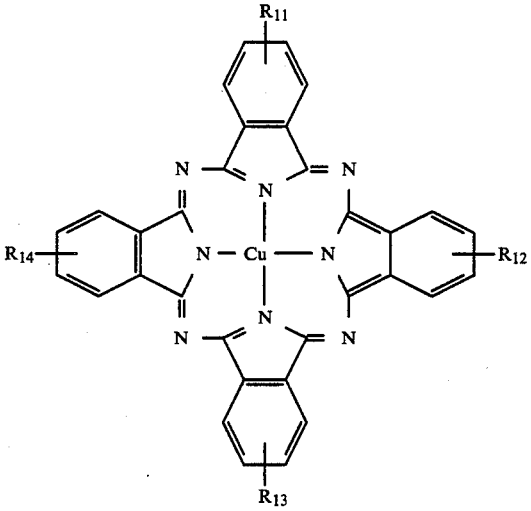
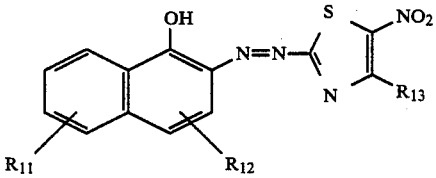
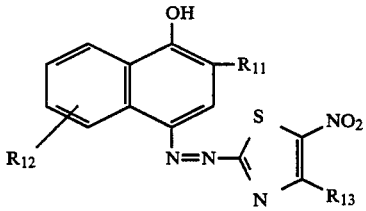
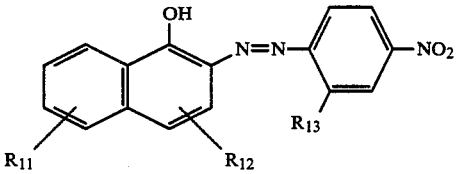

-continued

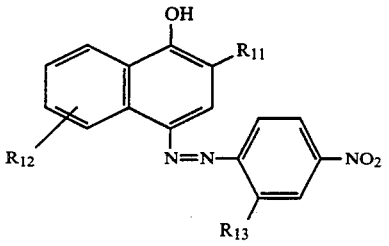

In the above described formulae, $R_{11}$ through $R_{16}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group, or an arylthio group.

Characteristics required for the image forming dye are as follows.

1. It has an excellent diffusibility, efficiently diffuses into the image receiving layer and fixes on the image receiving sheet in a high concentration.
2. It has a hue suitable for color reproduction.
3. It has a large molecular extinction coefficient.
4. It is fast to light and heat and stable for the dye releasing activator and other additives included in the system.
5. It is easily synthesized.

Specific examples include the following.

Yellow:

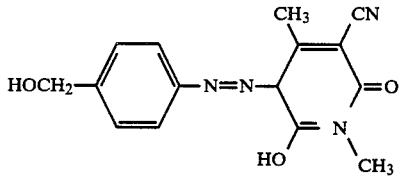

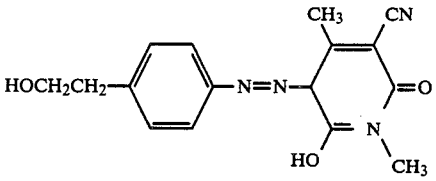

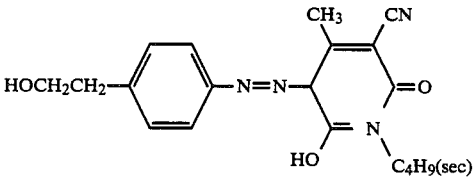

-continued

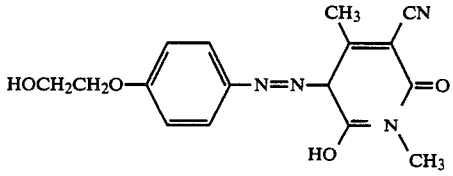

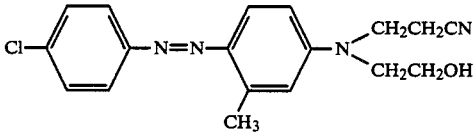

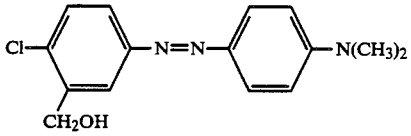

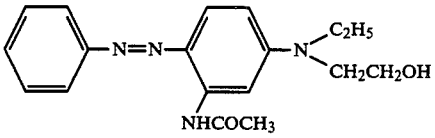

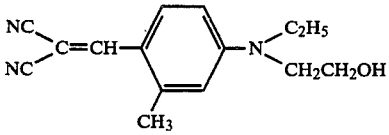

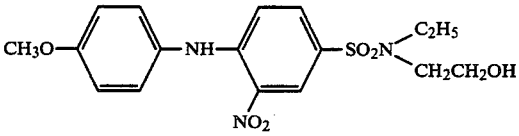

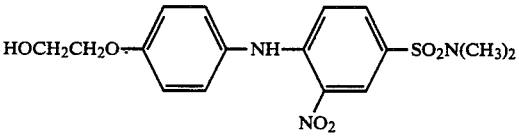

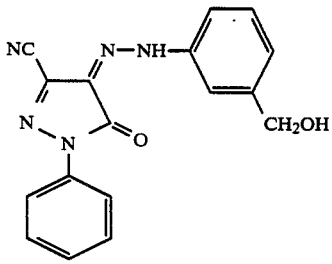

-continued
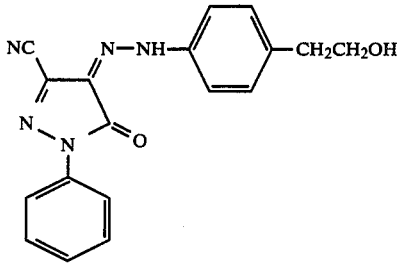
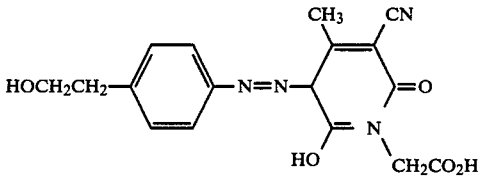
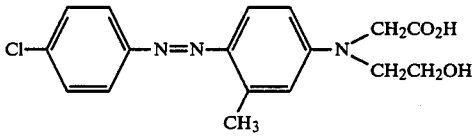
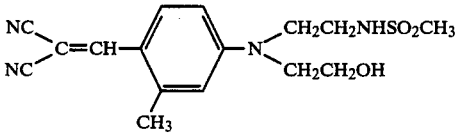
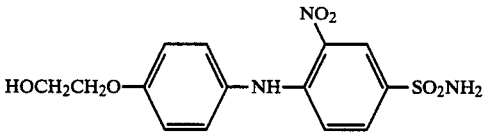
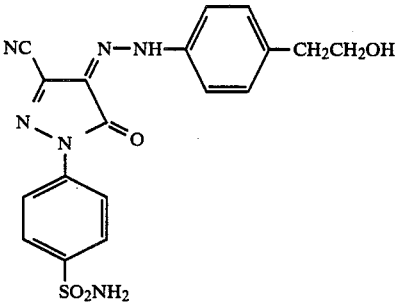
Magenta:
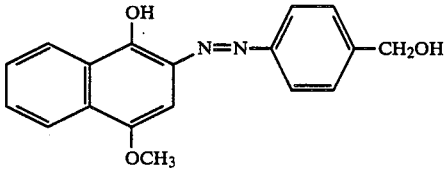
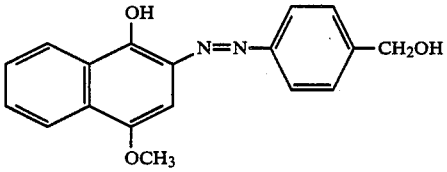
-continued
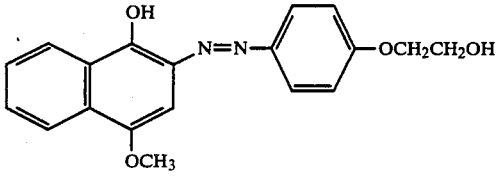
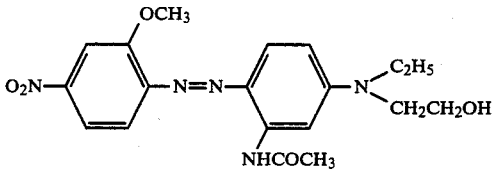
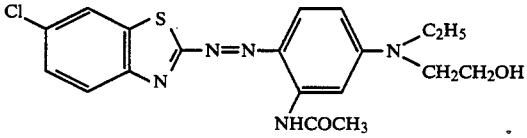
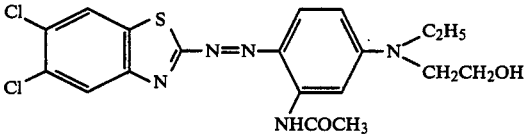
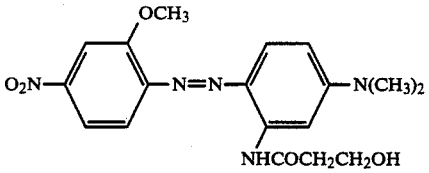
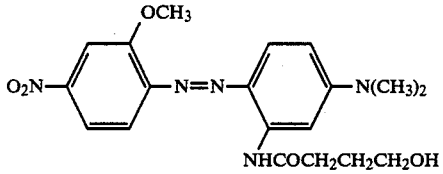
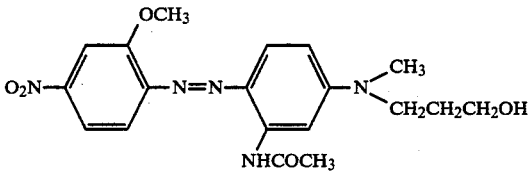
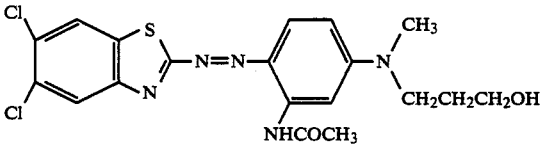
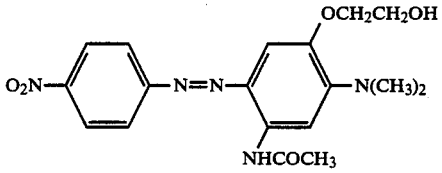

-continued
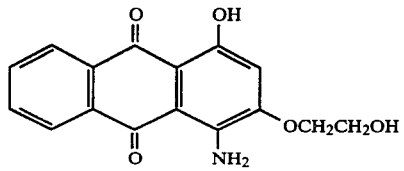
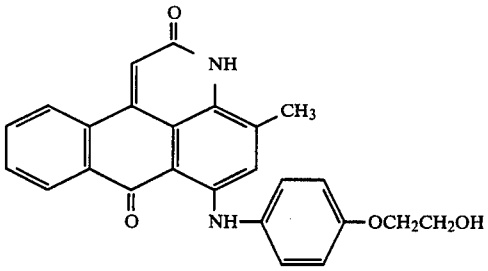
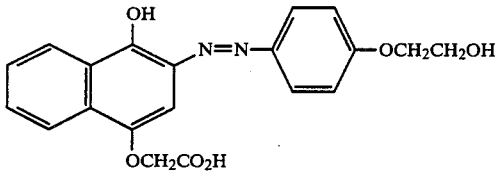
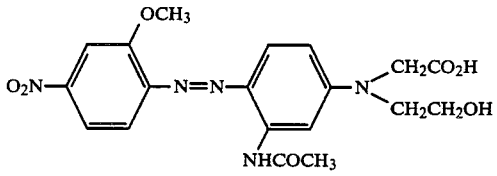
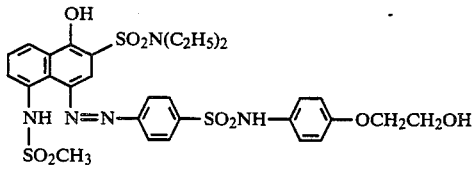
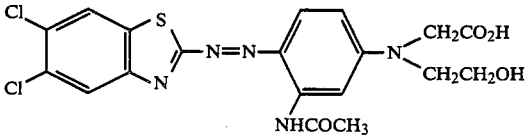
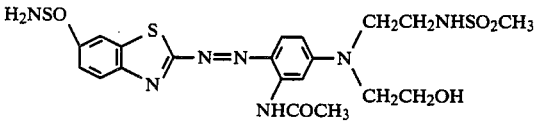
Cyan:
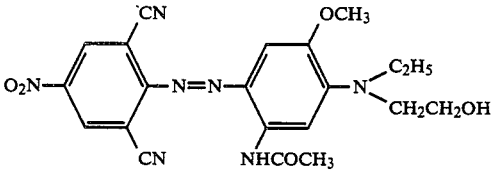
-continued
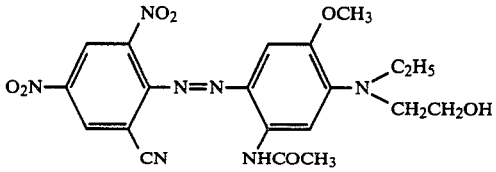
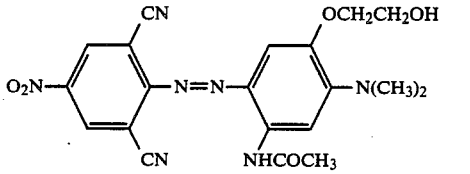
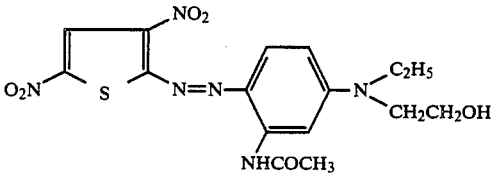
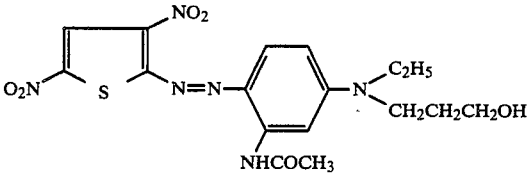
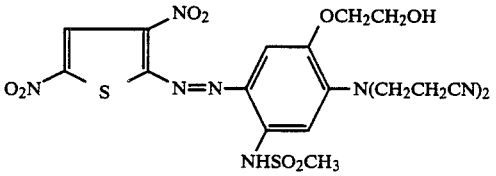
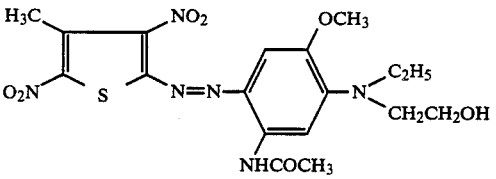
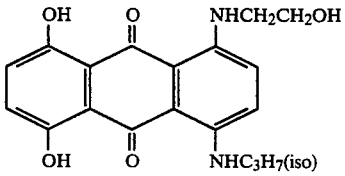
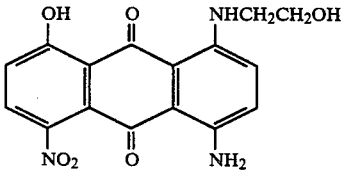
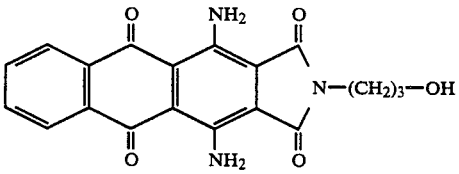

-continued

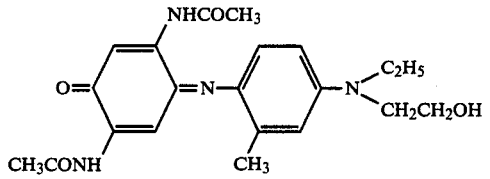

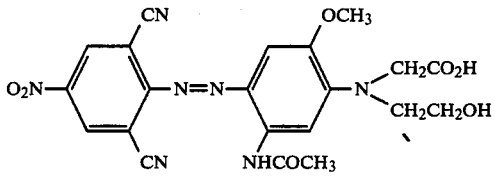

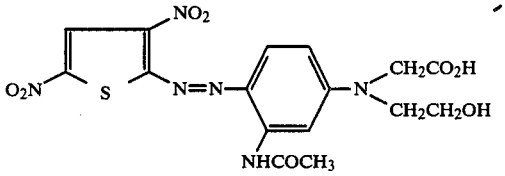

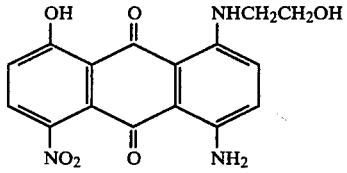

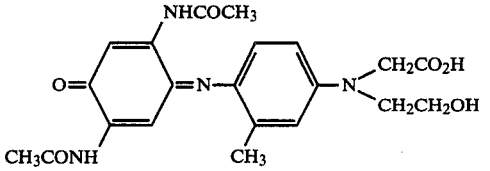

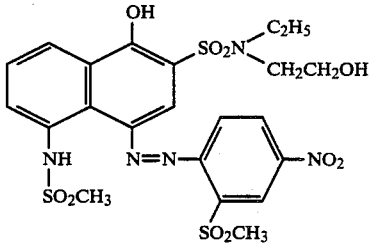

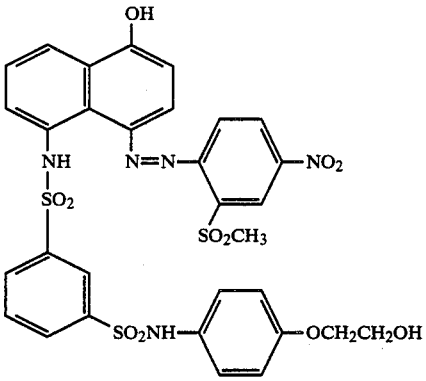

The image forming dyes are not limited to only the above-described dye compounds, but can be used in a dye precursor form (e.g., leuco form, such as a form in which the absorption maximum is temporarily shifted to shorter wavelength region, etc.).

The dye-providing substance of the present invention is involved in an oxidation-reduction reaction between the substance and a silver halide or an organosilver salt compound during development, wherein a nucleating reagent acts as a dye releasing activator, and as a result, a diffusible dye is released. This sequence is illustrated below.

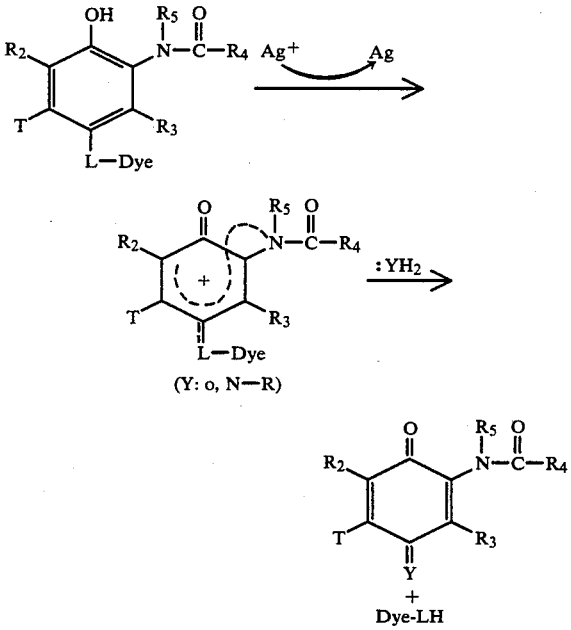

The above dye releasing mechanism is believed to be quite different from the dye releasing mechanism of Compounds (1) to (12) described above, and it is an unexpected finding that the 2-acylaminophenol derivatives have a sufficient reducibility against silver ions, and that dyes are effectively released from an oxidized compound by the nucleating reagent. It is also worth noting that the excellent characteristics of the dye providing substance of the present invention appear to be due to the effect of the acylamino group at the o-position of the phenolic hydroxyl group. It is known that o-sulfonamidophenol derivatives also have reducibility to silver ions; however, in such case the oxidized compound is cleaved by the nucleating reagent and the sulfonamido group is eliminated. On the other hand, a side reaction wherein the acylamino group is eliminated from the oxidized compound does not substantially occur in the compound of the present invention, and the dye release is predominant. As a result, a high dye releasing efficiency is exhibited.

The preferred dye providing substance of the present invention is an oxygen-elimination type substance, and the dye released therefrom has a terminal hydroxyl group. The dye having the terminal hydroxyl group has an excellent transferability as compared with the dye having the terminal sulfamoyl, released from Compounds (1) to (9) described before. This tendency is particularly remarkable in the case of using a hydrophobic binder or in the case of heat fixing the dye on a polymer film, and this results in a remarkable difference in the transferability. As a result, if the dye providing substance according to the present invention is used, a high dye transferring density can be obtained not only in the hydrophilic binder, but in a system using the hydrophobic binder.

It is also worthwhile that the nucleating reagent as the dye releasing activator can be selected from the wide ranges such as alkali hydroxides, water, amines, guanidines, amidines, hydrazines, ureas or their precursors.

From the standpoint that the dye providing substance itself has the reducibility with respect to silver ion, the dye providing substance of the present invention substantially differs from a colored coupler wherein an oxygen-elimination type diffusible dye is the releasing dye, as disclosed, for example, in British Pat. No. 1,330,524. The colored coupler itself does not have the reducibility to silver ion, and first releases the diffusible dye by the reaction of the oxidized compound of the developing agent.

The preferred dye providing substance which releases the diffusible dye is a substance that the substance itself does not fix on the image receiving sheet, and after being oxidized, only the dye released by the action of the dye releasing activator fixes on the image receiving sheet in a high density.

Therefore, the dye-providing substance in the preferred embodiment is one that it has a ballast group in the reducing group A, to prevent fixing the same on the image receiving sheet, and does not have a group in dye portion D, which disturbs fixing the dye on the image receiving sheet.

Preferred examples of the dye-providing substance are shown below.

(1)

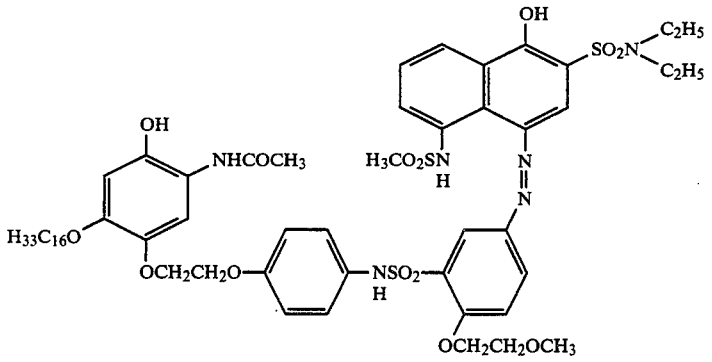

(2)

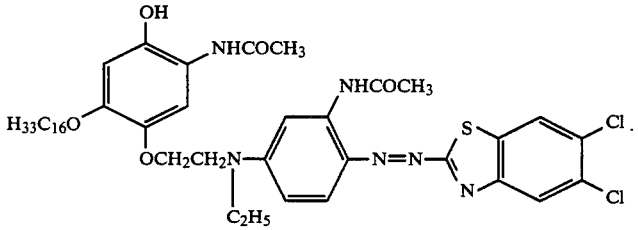

(3)

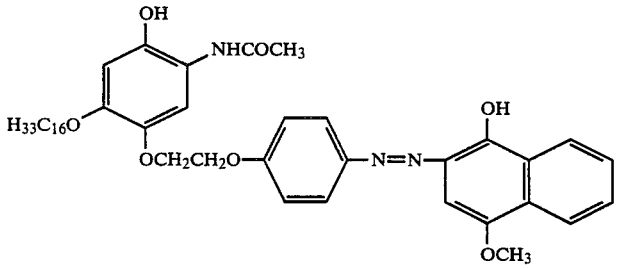

(4)

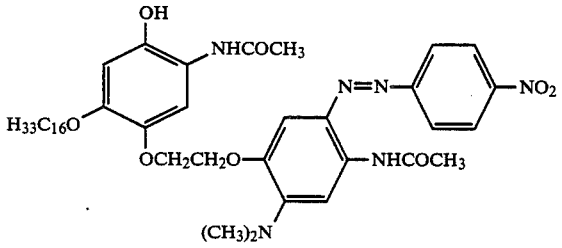

-continued
(5)
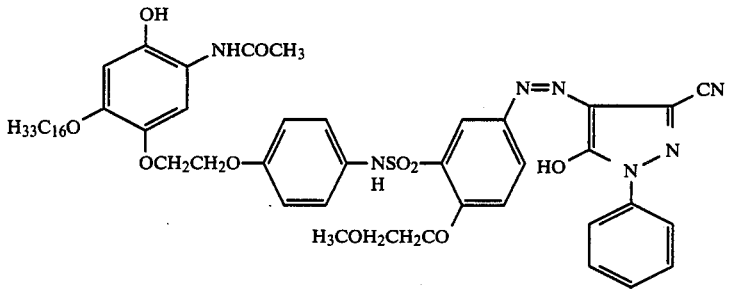
(6)
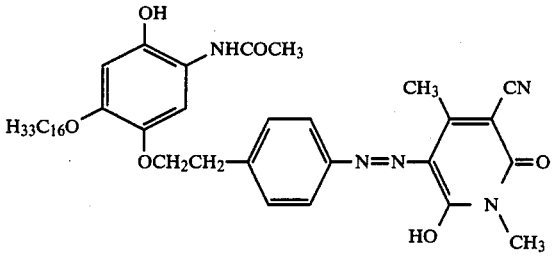
(7)
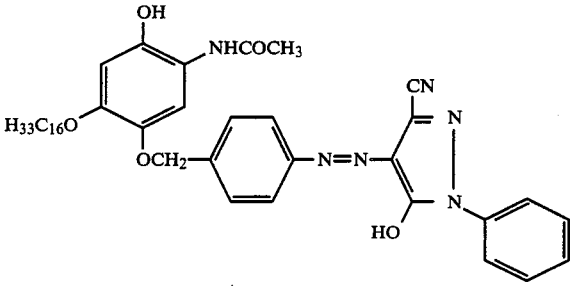
(8)
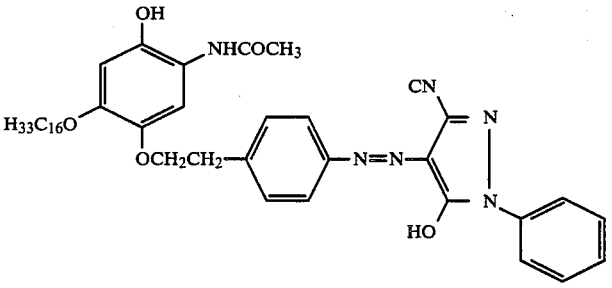
(9)
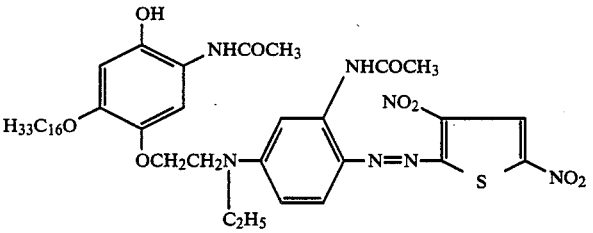
(10)
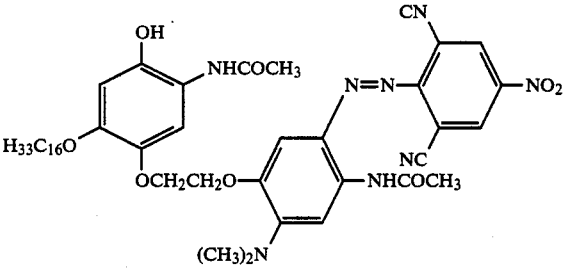

-continued
(11)
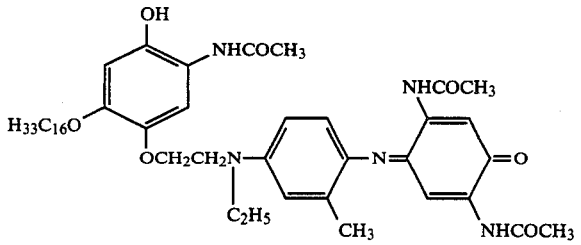
(12)
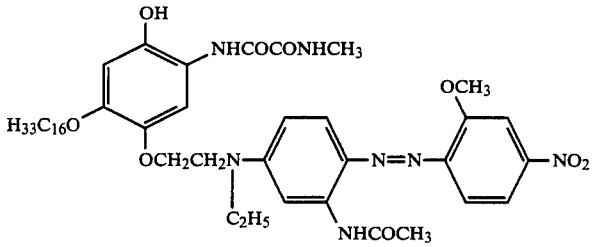
(13)
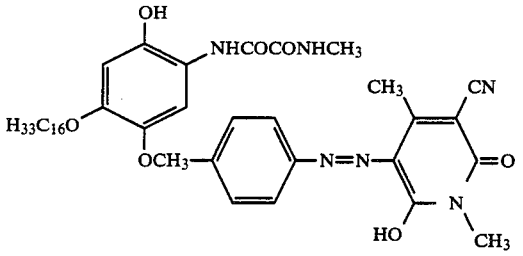
(14)
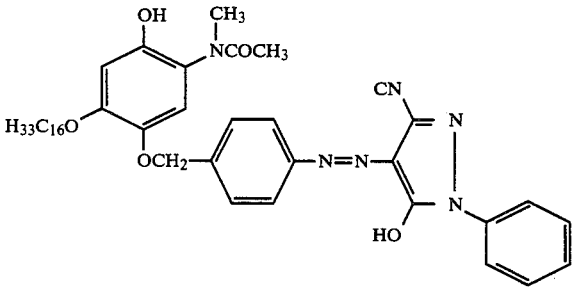
(15)
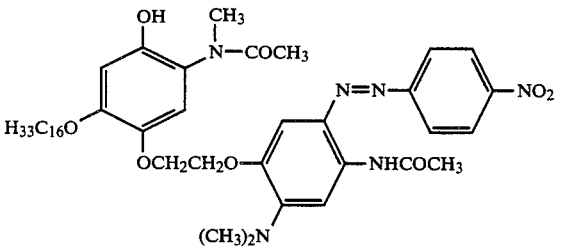
(16)
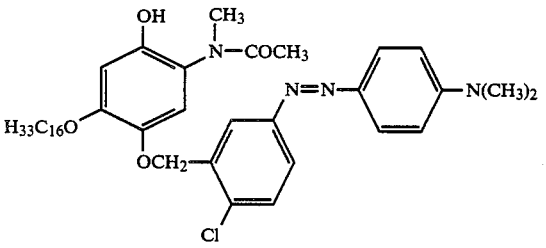

-continued
(17)
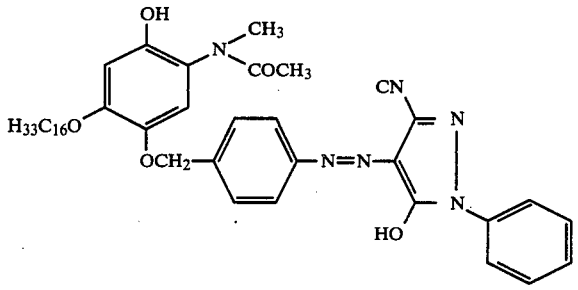
(18)
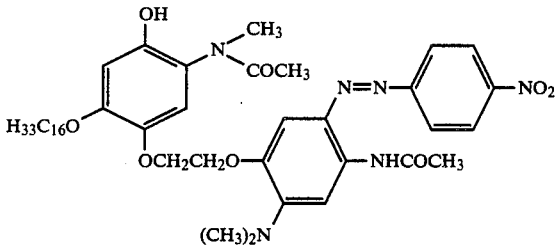
(19)
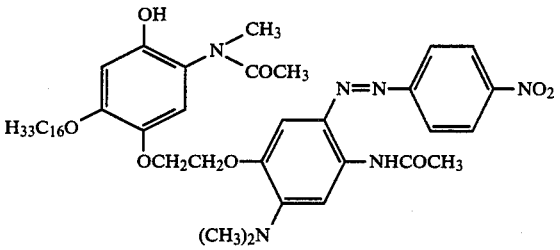
(20)
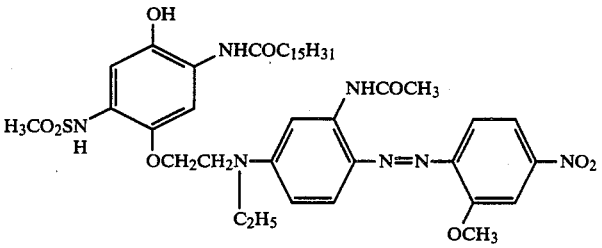
(21)
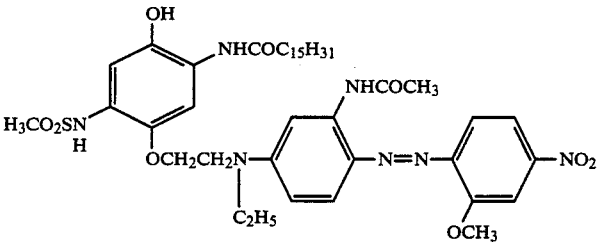
(22)
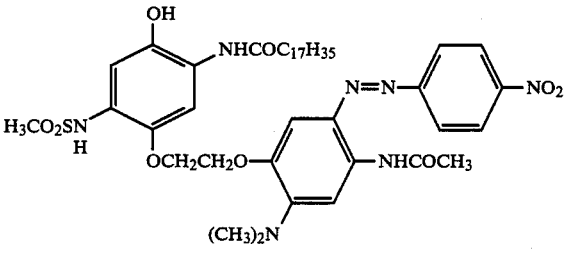

-continued
(23)
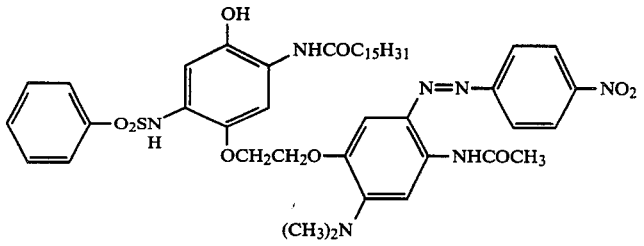
(24)
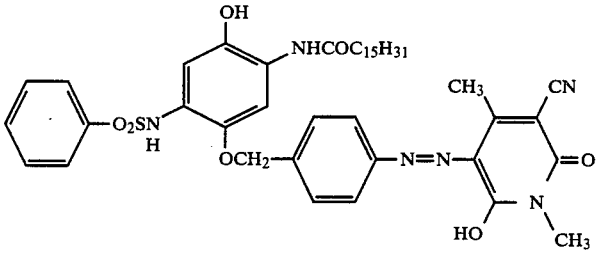
(25)
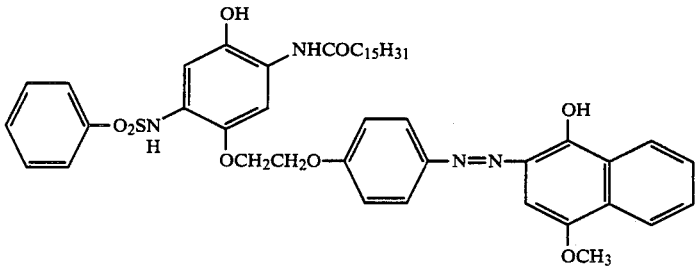
(26)
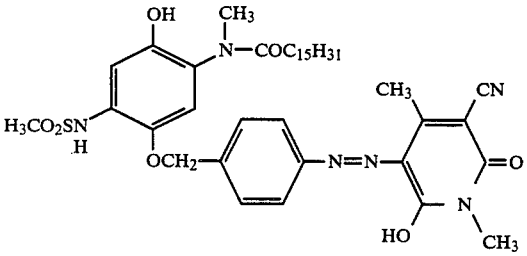
(27)
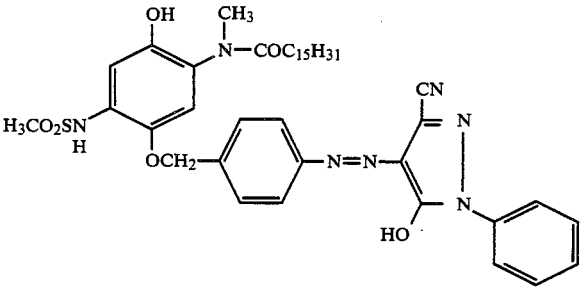
(28)
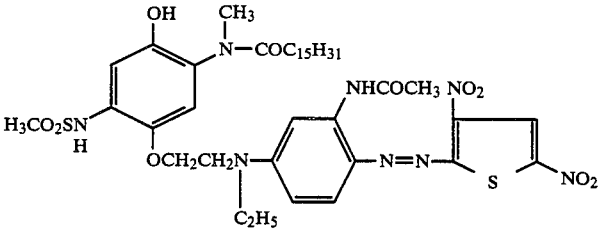

-continued
(29)
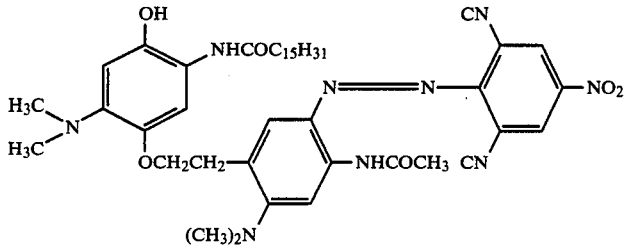
(30)
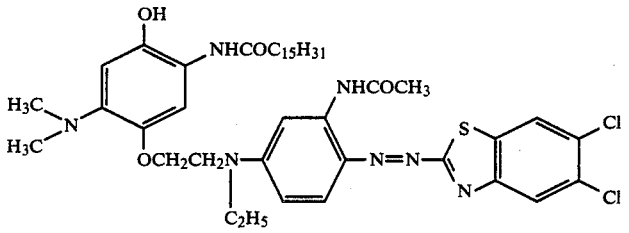
(31)
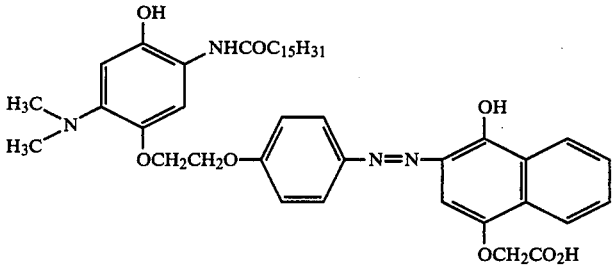
(32)
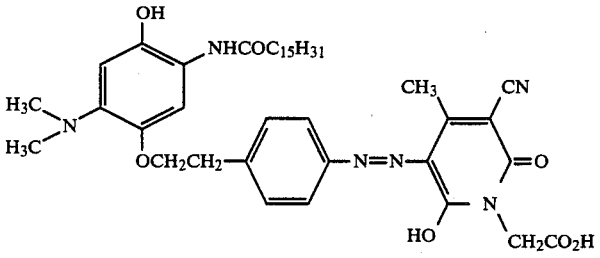
(33)
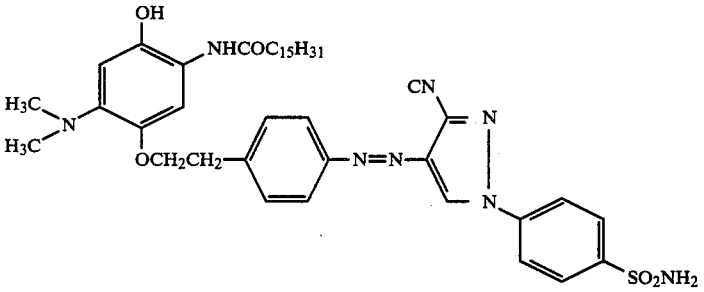
(34)
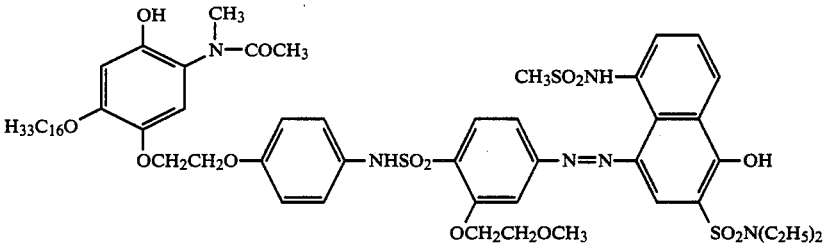

-continued (35)

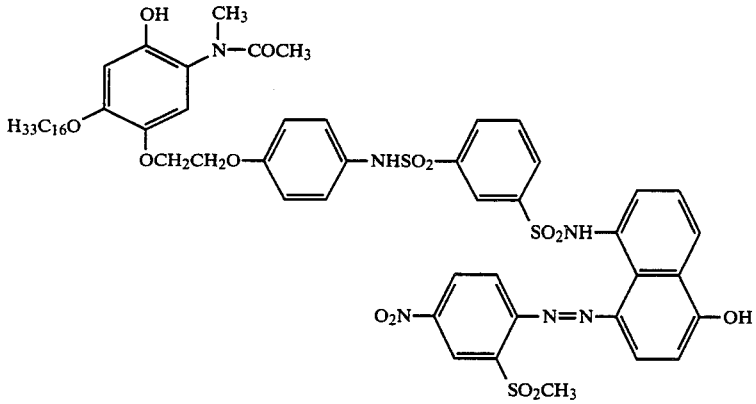

Synthesis of the dye-providing substance is described below.

The dye-providing substance of the present invention is represented by the formula A-L-D, wherein A is a reducing group, L is a bonding group, and D is an image forming dye or dye precursor, and is generally synthesized by the following scheme.

$$A-H + T-L-D \xrightarrow[-HT]{Base} A-L-D$$

Further, this synthesis is roughly classified into the following three schemes.

Scheme A:

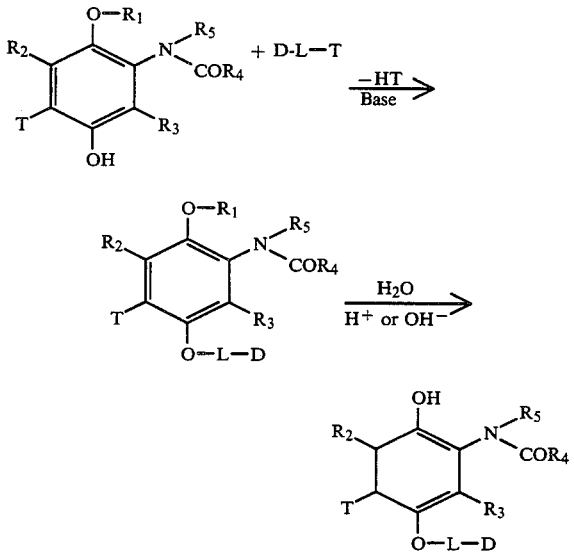

Scheme B:

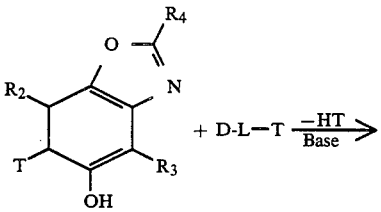

-continued

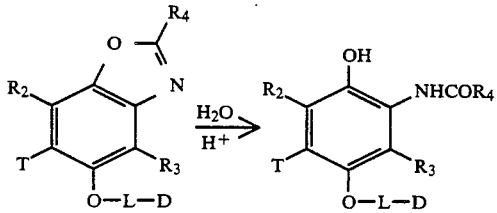

Scheme C:

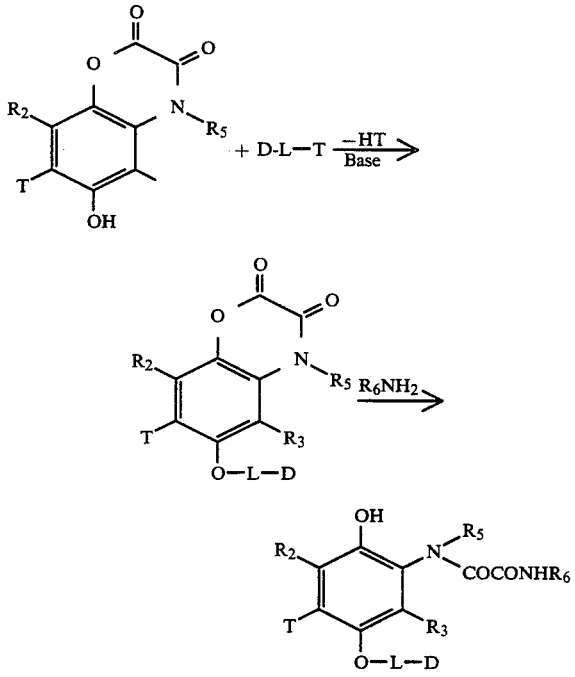

Specific synthesis examples are set forth below

SYNTHESIS EXAMPLE 1

1. Synthesis of Dye-Providing Substance (1)

(1-a) 2-Acetylamino-4-amino-5-hexadecyloxyphenol (1-a)

196 g of 2-acetylamino-5-hexadecyloxyphenol was suspended in 1.5 l of 2-methoxyethanol, and 200 ml of an aqueous solution containing 98.5 g of potassium hydroxide was added thereto at 10° C. or less. This was designated as Solution (A).

To 300 ml of an aqueous suspension containing 75.4 g of anthranilic acid, 105 ml of concentrated hydrochloric acid was dropwise added with heating and stirring, and the mixture was cooled at 5° C. or less after dissolution. 100 ml of an aqueous solution containing 39.9 g of sodium nitrite was added and the mixture was stirred at 5° C. or less for 1 hour. This was designated as Solution (B).

Solution (A) was added to Solution (B) at 10° C. or less. After stirring for 1 hour, 1.2 l of an aqueous solution containing 256 g of sodium hydrosulfite was added at 60° C. After stirring for 1 hour, it was cooled with ice, and light brown crystals were filtered off, washed with methanol and dried. Yield: 183 g.

(1-b) 2-Acylamino-5-hexadecyloxybenzoquinone (1-b)

To a mixture composed of 203 g of (1-a), 56 ml of concentrated hydrochloric acid, 53 ml of water and 2 l of acetone, 217 g of manganese dioxide was added with stirring. After stirring at room temperature for 5 hours, 400 ml of dichloromethane was added, and the mixture was refluxed with heating for 2 hours. It was filtered at once with Celite (trademark for diatamaceous earth). After being allowed to cool, the precipitate formed was filtered off, washed with methanol, and dried. Yield: 192 g.

(1-c)
2-Acetylamino-5-hexadecyloxy-1,4-dihydroxybenzene (1-c)

200 ml of an aqueous solution containing 56.2 g of sodium hydrosulfite was added to a mixture composed of 95.0 g of (1-b) and 1 l of acetone under refluxing with heat. After stirring for 1 hours, 400 ml of acetone was distilled away. After being allowed to cool, the precipitate formed was filtered off, washed with acetone, and dried. Yield: 93 g.

(1-d) 6-Hexadecyloxy-5-hydroxy-2-methylbenzoxazole (1-d)

A mixture composed of 93.0 g of (1-c), 22.3 g of p-toluenesulfonic acid monohydrate and 1 l of toluene was refluxed with heating for 3 hours to distill away the water formed. After being allowed to cool, the crystals formed were washed with acetone and dried. Yield: 73 g.

(1-e)
6-Hexadecyloxy-2-methyl-5-[2-(4-nitrophenyl)oxy]ethoxybenzoxazole (1-e)

A mixture composed of 62.1 g of (1-d), 58.8 g of p-toluenesulfonic acid 4-nitrophenyloxyethyl ester, 24.1 g of potassium carbonate and 360 ml of dimethylacetamide was stirred for 3 hours on a hot water bath. After the reaction mixture was filtered by suction, methanol was added to the precipitate, and the precipitate formed was filtered off. Yield: 57 g.

(1-f)
2-Acetylamino-4-[2-(4-aminophenyl)oxy]ethoxy-5-hexadecyloxyphenol (1-f)

A mixture composed of 41 g of (1-e), 45 ml of concentrated hydrochloric acid and 450 ml of ethanol was stirred at 50° C. for 9 hours. After being allowed to cool, the formed crystals were washed with ethanol and filtered off. Yield: 18 g.

(1-g)
2-Acetylamino-4-[2-(4-aminophenyl)oxy]-ethoxy-5-hexadecyloxyphenol (1-g)

A mixture composed of 13 g of (1-f), 12 g of reduced iron, 1.2 g of ammonium chloride, 100 ml of isopropyl alcohol and 10 ml of water was stirred for 4 hours. After filtering with Celite, methanol was added, and the precipitate formed was filtered off. Yield: 11 g.

(1-h) Dye-providing substance (1)

After a mixture composed of 5.4 g of (1-g), 6.5 g of 2-diethylaminosulfonyl-4-(4-methoxyethoxy-3-chlorosulfonyl)-phenylazo-8-methanesulfonylamino-naphthol, 3 g of pyridine and 50 ml of dimethylacetamide was stirred for 1 hour with cooling with ice, it was poured into weakly acidic iced water, and the formed crystals were filtered off. After drying, they were purified by silica gel chromatography to obtain 10 g of Dye-providing substance (1).

SYNTHESIS EXAMPLE 2

2. Synthesis of Dye-Providing Substance (5):

(2-l) Dye-providing substance (5)

After a mixture composed of 5.25 g of (1-g), 5.07 g of 4-(3-chlorosulfonyl-4-methoxyethoxy)phenylazo-3-cyano-5-hydroxy-1-phenylpyrazole, 3 g of pyridine and 50 ml of dimethylacetamide was stirred for 1 hour while cooling with ice, it was poured into weakly acidic ice water, and the crystals formed were filtered off. After drying, they were purified by silica gel chromatography to obtain 8 g of Dye-providing substance (5).

SYNTHESIS EXAMPLE 3

3. Synthesis of Dye-Providing Substance (35)

(3-a)
2-(N-Acetyl-N-methyl)amino-5-hexadecyloxy-4-[2-(4-nitrophenyl)oxy]ethoxyphenol (3-a)

A mixture composed of 22.2 g of (1-e), 80 ml of toluene, and 30 ml of p-toluenesulfonic acid methyl ester was refluxed for 1 hour with heating. After toluene was distilled away under reduced pressure, 150 ml of tetrahydrofuran and 200 ml of an aqueous solution containing 15 g of sodium acetate were added. After 15 minutes, the crystals formed were filtered off and washed with methanol. Yield: 20.1 g.

(3-b)
2-(N-Acetyl-N-methyl)amino-5-hexadecyloxy-4-[2-(4-aminophenyl)oxy]ethoxyphenol (3-b)

A mixture composed of 20.1 g of (3-a), 18 g of reduced iron, 15 ml of an aqueous solution containing 1.9 g of sodium chloride and 150 ml of isopropyl alcohol was heated on a hot water bath for 5 hours. After it was filtered through Celite with heating, the reaction mixture was poured into ice water, and the crystals formed were washed with methanol. Yield: 17.5 g.

(3-c) Dye-providing substance (35)

A mixture composed of 7.5 of (3-b), 8.5 g of 5-(3-chlorosulfonylphenyl)sulfonylamino-4-(2-methylsulfonyl-4-nitro)phenylazonaphthol, 4 g of pyridine and 60 ml of dimethylacetamide was stirred for 1 hour while cooling with ice, and it was poured into weakly acidic ice water. The formed crystals were filtered off. After drying, they were purified by silica gel chromatography, to obtain 13 g of Dye-providing substance (35).

Reducing dye-providing 2-acylaminophenol derivatives of the present invention are used in a range of 0.01 mol to 10 mols, preferably 0.01 mol to 1 mol, based on silver contained in the light-sensitive material.

The reducing dye-providing 2-acylaminophenol derivatives of the present invention are useful for diffusion transfer type color photographic light-sensitive materials. The diffusion transfer type color photographic light-sensitive materials include various forms, such as those using a developing solution at a normal temperature (e.g., room temperature of about 20°-30° C.) or those utilizing thermal development, but the 2-acylaminophenol derivatives of the present invention are not particularly limited, and can be effectively used for many forms. In the following, preferred embodiments of the light-sensitive materials containing 2-acylaminophenol derivatives of the present invention are described.

One embodiment of a light-sensitive material containing the dye-providing substance of the present invention comprises (1) a base,
(2) a light-sensitive element,
(3) an image-receiving element,
(4) a processing element, and
(5) a developer (in the processing element or in the light-sensitive element).

For the above described embodiment, recommendable embodiment is disclosed, e.g., in Belgium Pat. No. 757,959. According to this embodiment, an image receiving layer, a substantially opaque light-reflection layer (for example, a $TiO_2$ layer and a carbon black layer) and one or more of light-sensitive layers containing the dye-providing substance of the present invention (light-sensitive element) are applied in turn to a transparent base, and a transparent cover sheet is superimposed in a face-to-face relation. A destructible container accommodating an alkaline processing composition containing an opaque agent for shielding light (for example, carbon black) is placed so as to be adjacent to the top layer (protective layer) of the above described light-sensitive layer and to the transparent cover sheet. Such a film unit is exposed to light through the transparent cover sheet. When it is removed from the camera, the container is broken by a pressing member to spread the processing composition (containing the opaque agent) between the light-sensitive layer and the cover sheet. Thus the light-sensitive element intercepts light in a sandwiched state and development proceeds even with the film unit being in the light.

In film units of these embodiments, it is recommended to incorporate a neutralizing mechanism.

It is particularly preferred to provide a neutralizing layer on the cover sheet (if necessary, to further provide a timing layer on the side where the processing solution is spread).

Other useful embodiments capable of using the dye-providing substances of the present invention have been described in U.S. Pat. Nos. 3,415,644, 3,415,645, 3,415,646, 3,647,487 and 3,635,707 and German Patent Application (OLS) No. 2,426,980.

Another embodiment of a color light-sensitive materials that can contain the 2-acylaminophenol derivatives of the present invention is a heat-developable color light-sensitive material.

Diffusion transfer type heat-developable color light-sensitive materials are composed of a light-sensitive element comprising: (a) light-sensitive silver halide, (b) an organic silver salt oxidizing agent, (c) a reducing agent, (d) a dye-providing substance, (e) a binder, and (f) a base, and an image receiving element. In the present invention, the dye-providing substance of (d) is the reducing 2-acylaminophenol derivative, and it is not necessary to use the reducing agent of (c). In a specific case, silver halide is used as an oxidizing agent in addition to light-sensitization, and the organic silver salt oxidizing agent of (b) can be omitted. In the light-sensitive element, it is possible if desired, to incorporate base generating agents, silver salt stabilizer, sensitizing dyes, antihalation dyes, anti-irradiation dyes, thermal solvent, etc., in addition to (a)-(f).

Silver halide includes silver chloride, silver chlorobromide, silver chloroiodide, silver bromide, silver iodobromide, silver chloroiodobromide, silver iodide, etc., which are described in detail in *The Theory of the Photographic Process,* 4th edition, Chapter 5, pages 149-169, T. H. James, ed., 1977. As the organic silver salt oxidizing agents, silver salts of aliphatic and aromatic carboxylic acids and silver salts of nitrogen containing heterocyclic compounds are suitably used. As compounds used in the heat-developable light-sensitive materials, those described, e.g., in *Research Disclosure,* July 1978, vol. 170, RD No. 17029 can be used.

The heat-developable color light-sensitive materials of the present invention can provide the silver image having a negative-positive relation to the original and the diffusible dye in the part corresponding to the silver image at the same time by only carrying out thermal development after imagewise exposing to light. Namely, when the heat-developable color light-sensitive materials of the present invention are imagewise exposed to light and developed with heating, the exposed light-sensitive silver halide acts as a catalyst to cause an oxidation-reduction reaction between the organic silver salt oxidizing agent and the reducing dye-providing substance, by which a silver image is formed on the exposed part. In this step, the dye-providing substance is oxidized by the organic silver salt oxidizing agent to form an oxidized product. This oxidized product cleaves in a presence of a dye-releasing activator and, consequently, a diffusible dye is released. Thus, the silver image and a diffusible dye image are obtained on the exposed part, and a color image is obtained by transferring the diffusible dye.

The expression "dye releasing activator" in the above refers to a substance which nucleophilically attacks the oxidized dye-providing substance to allow release of a diffusible dye. Bases, base releasing agents, and water-releasing agents are used.

The base used in the present invention may have the function of being a support and the function of receiving the released diffusible dye at the same time. Namely, on a synthetic polymer film, paper, glass, etc., which can endure to processing temperature, a mordanting layer or a nonionic polymer layer is formed, as occasion demands, to give a dye receiving property. The base may be allowed to receive the direct dye, as in the case of a polyethylene terephthalate film.

Preferred embodiments of the present invention are as follows.

1. Color photographic light-sensitive materials containing at least one dye-providing 2-acylaminophenol derivatives wherein the reducing group A of the formula (II) is that oxidation-reduction potential to a saturated calomel electrode is 1.2 V or less in case of measuring polarographic half wave potential using actonitrile as a solvent and sodium perchlorate as a support electrolyte.

2. Heat-developable light-sensitive materials containing at least one 2-acylaminophenol derivatives as a dye-providing substance.

3. Color photographic light-sensitive materials wherein a dye-providing 2-acylaminophenol derivative is used together with a reducing agent.

4. Color photographic light-sensitive materials wherein a diffusible dye released from the dye-providing 2-acylaminophenol derivative by development is diffused and transferred to an image receiving sheet containing a mordanting agent to obtain a color image.

5. Heat-developable color light-sensitive materials wherein a diffusible dye released from the dye-providing 2-acylaminophenol derivative by thermal development is heat transferred to a dye receiving base to form a color image.

EXAMPLE 1

A silver benzotriazole emulsion containing light-sensitive silver bromide was produced as follows.

(A)

Benzotriazole: 12 g
Isopropyl alcohol: 200 g (B)

$AgNO_3$: 17 g
$H_2O$: 50 ml (C)

LiBr: 2.1 g
Ethanol: 20 ml

Solution B was added to Solution A at 40° C. with stirring. The solution A became cloudy and silver salt of benzotriazole was formed.

When Solution C was added to the above described solution, silver was supplied from the silver benzotriazole and a part of the silver was converted into silver bromide.

Powdery crystals produced as described above were filtered off and added to a solution prepared by dissolving 20 g of polyvinyl butyral in 200 ml of isopropyl alcohol. The mixture was processed by a homogenizer for 30 minutes to obtain a dispersion.

To 10 g of the above described silver benzotriazole emulsion containing light-sensitive silver bromide, a solution prepared by dissolving 0.80 g of dye-providing substance (1) and 0.22 g of guanidine trichloroacetic acid in a mixture of 4 ml of ethyl alcohol and 2 ml of N,N-dimethylformamide was added, and the mixture was stirred. Thereafter, the above described solution was applied to a polyethylene terephthalate film having a thickness of 180 μm so as to result in a wet film thickness of 100 μm. After the resulting light-sensitive material was dried, it was imagewise exposed to light at 20,000 lux for 10 seconds with a tungsten lamp. This imagewise exposed sample was uniformly heated on a heat block heated to 160° C. for 120 seconds. After the sample was cooled to room temperature, the coated emulsion layer was physically separated from the polyethylene terephthalate film by means of an adhesive tape. A transferred clear magenta negative image was obtained on the polyethylene terephthalate film. When magenta densities of the negative image were measured by means of a Macbeth transmission densitometer (TD-504), the maximum density to green light was 1.80 and the minimum density to green light was 0.16. Gradation of sensitometric curve was a density difference in the straight line part of 0.80, based on an exposure difference of 10 times.

EXAMPLE 2

6.5 g of benzotriazole and 10 g of gelatin were dissolved in 1000 ml of water. The resulting solution was stirred while maintaining it at 50° C. A solution prepared by dissolving 8.5 g of silver nitrate in 100 ml of water was then added to the above described solution over 2 minutes.

A solution prepared by dissolving 1.2 g of potassium bromide in 50 ml of water was then added over 2 minutes. The prepared emulsion was precipitated by controlling pH to remove excess salts. Thereafter, pH of the emulsion was adjusted to 6.0. Yield was 200 g.

In the following, the way of making a gelatin dispersion of the dye-providing substance is illustrated.

A solution prepared by dissolving 18 g of dye-providing substance (1) and 0.5 g of the surface active agent: sodium succinic acid-2-ethyl-hexyl ester sulfonate in a mixture of 20 ml of ethyl acetate and 4 ml of N,N-dimethylformamide was mixed with 100 g of a 10% aqueous solution of gelatin, and, thereafter, the mixture was processed by a homogenizer at 10,000 rpm for 10 minutes to prepare a dispersion. This dispersion was designated as the dispersion of dye-providing substance (1).

In the following, a process for preparing a coated product is illustrated.

(a)

Silver benzotriazole emulsion containing light-sensitive silver bromide: 10 g (b)

Dispersion of dye-providing substance: 3 g (c)

5 wt% methanol solution of guanidine trichloroacetic acid: 2 ml

After the above described (a)–(c) were mixed with stirring, the mixture was applied to a polyethylene terephthalate film having a thickness of 180 μm so as to result in a wet film thickness of 100 μm. After the coated sample was dried, it was imagewise exposed to light at 2000 lux using a tungsten lamp. Thereafter, the sample was uniformly heated for 60 seconds on a heat block heated to 160° C. When the emulsion layer was removed after being cooled to room temperature, a magenta negative transfer image was obtained on the polyethylene terephthalate film.

With respect to densities of the transfer image, the maximum density to green light was 1.85 and the minimum density to green light was 0.25.

EXAMPLE 3

10 g of dye-providing substance (31), 0.5 g of the surface active agent: sodium succinic acid-2-ethyl-hexylester sulfonate and 4 g of tricresyl phosphate (TCP) were weighed, and 20 ml of cyclohexanone was added thereto. The mixture was dissolved by heating to about 60° C. to form a homogeneous solution. After this solution was mixed with 100 g of a 10% solution of lime-processed gelatin with stirring, the mixture was processed by a homogenizer at 10,000 rpm for 10 minutes to obtain a dispersion. This dispersion was designated as the dispersion of dye-providing substance (31).

After 10 g of a silver benzotriazole emulsion containing light-sensitive silver bromide used in Example 2, 3.4 g of a dispersion of dye-providing substance (31) and a solution prepared by dissolving 0.11 g of guanidine trichloroacetic acid in 2 ml of methanol were mixed to dissolve, the mixture was applied to a polyethylene terephthalate film having a thickness of 180 μm so as to result in a wet film thickness of 60 μm. After the coated sample was dried, it was imagewise exposed to light at 20,000 lux for 10 seconds using a tungsten lamp. Thereafter, it was uniformly heated for 30 seconds on a heat block heated to 150° C.

In the following, a method of forming an image receiving material having an image receiving layer is illustrated.

10 g of poly(methyl acrylate-co-N,N,N-trimethyl-N-vinylbenzylammonium chloride) (ratio of methyl acrylate and vinylbenzylammonium chloride was 1/1) dissolved in 200 ml of water was uniformly mixed with 100 g of 10% lime-processed gelatin. The mixture was uniformly applied to a polyethylene terephthalate film so as to result in a wet film thickness of 20 μm. After the resulting sample was dried, it was used as an image receiving material.

After the image receiving material was immersed in water, the above described heated light-sensitive material was superposed on it so as to touch with the coated face. When the image receiving material was separated from the light-sensitive material after the passage of 30 seconds, a negative magenta image was obtained on the image receiving material. When densities of this negative image were measured by a Macbeth transmission densitometer (TD-504), the maximum density to green light was 2.00 and the minimum density to green light was 0.14.

EXAMPLE 4

The same operation and processing as in Example 1 were carried out except that 0.80 g of compound (5) was used instead of the dye-providing compound (1) in Example 1. As a result, a yellow transfer image was obtained on the polyethylene terephthalate film.

EXAMPLE 5

The same operation and processing as in Example 1 were carried out except that 0.5 g of dye-providing compound (9) was used. As a result, a cyan transfer image was obtained on the polyethylene terephthalate film.

EXAMPLE 6

A photographic light-sensitive sheet was produced by applying to a polyethylene terephthalate transparent base as follows.

(1) A mordanting layer containing 3.0 g/m$^2$ of the following mordanting agent and 3.0 g/m$^2$ of gelatin.

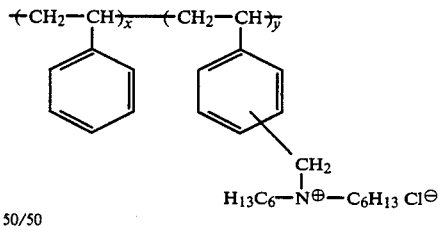

(2) A white reflection layer containing 20 g/m$^2$ of titanium oxide and 2.0 g/m$^2$ of gelatin.

(3) A light shielding layer containing 2.7 g/m$^2$ of carbon black and 2.7 g/m$^2$ of gelatin.

(4) A layer containing dye-providing substance (31) of the present invention (0.8 g/m$^2$), diethyl laurylamide (0.2 g/m$^2$) and gelatin (1.08 g/m$^2$).

(5) A layer containing a green-sensitive internal latent image type direct reversal silver iodobromide emulsion (halogen composition in silver halide: iodine 1 mol %, silver amount 2.0 g/m$^2$, gelatin 1.5 g/m$^2$), a fogging agent represented by the following formula (0.08 mg/m$^2$)

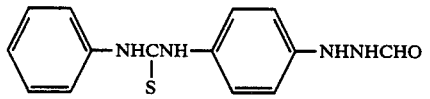

and sodium 5-pentadecyl-hydroquinone-2-sulfonate (0.18 g/m$^2$).

(6) A layer containing gelatin (0.94 g/m$^2$).

Further, the following processing solution and cover sheet were produced.

Processing solution

1-Phenyl-4-methyl-4-hydroxymethyl-3-pyrazolidone: 10 g
Methylhydroquinone: 0.18 g
5-Methylbenzotriazole: 4.0 g
Sodium sulfite (anhydrous): 1.0 g
Na salt of carboxymethyl cellulose: 40.0 g
Carbon black: 150 g
Potassium hydroxide (28% aqueous solution): 200 cc
$H_2O$: 550 cc The processing solution having the above described composition was put in containers capable of breaking by pressure with 0.8 g portions.

Cover sheet

To a polyethylene terephthalate transparent base, 15 g/m$^2$ of polyacrylic acid (10 wt% aqueous solution, viscosity: about 1,000 cp) was applied as a neutralizing acid polymer layer and a mixture of 3.8 g/m$^2$ of acetyl cellulose (39.4 g of acetyl group was formed by hydrolyzing 100 g of acetyl cellulose) and 0.2 g/m$^2$ of poly(styrene-co-maleic acid anhydride) (composition: styrene/maleic acid anhydride=about 60/40, molecular weight: about 50,000) was applied thereto as a neutralizing timing layer to produce a cover sheet.

The above described cover sheet was superposed on the light-sensitive sheet. After they were exposed to light from the cover sheet side through a wedge having stepwise different densities, the above described processing solution was spread between both sheets so as to result in a thickness of 85μ (spreading was carried out by means of a press roller). Processing was carried out at 25° C. When transfer image density was examined through the transparent base of the light-sensitive sheet after the passage of 5 minutes, magenta transfer images corresponding to each density of the wedge were obtained.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising at least one silver halide emulsion layer and at least one dye-providing 2-acylaminophenol derivative represented by formula (I)

A—L—D (I)

wherein A represents a reducing group represented by the formula (II)

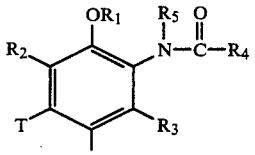

(II)

wherein $R_1$ represents a hydrogen atom or an acyl group, and $R_2$, $R_3$, $R_4$, and $R_5$ each represents a substituent selected from a hydrogen atom, alkyl group, cycloalkyl group, alkenyl group, aryl group, alkoxy group, aryloxy group, aralkyl group, acylamino group, alkylamino group, dialkylamino group, arylamino group, diarylamino group, halogen atom, acyloxy group, hydroxyl group, carboxyl group, cyano group, acyl group, carbamoyl group, substituted carbamoyl group, sulfamoyl group, substituted sulfamoyl group, sulfamoylamino group, substituted sulfamoylamino group, ureido group, substituted ureido group, alkylsulfonyl group, arylsulfonyl group, alkylsulfonylamino group, arysulfonylamino group and nitro groups, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group, and T represents a substituent selected from alkoxy group, aryloxy group, alkylsulfonylamino group, arylsulfonylamino group, alkylamino group, dialkylamino group, arylamino group and diarylamino group, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group;

L represents a bonding group selected from the divalent group

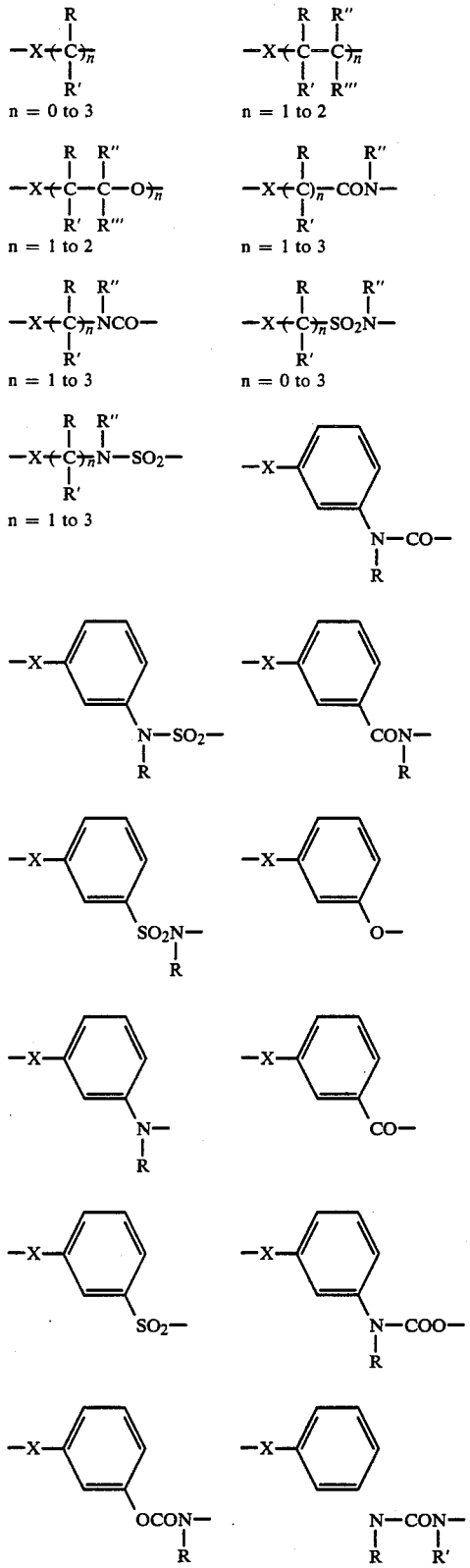

wherein R, R', R'', and R'' each represents a substituent selected from a hydrogen atom, methyl group, ethyl group, hydroxymethyl group, methoxymethyl group, carboxymethyl group, cyanomethyl group, hydroxyethyl group, methoxyethyl group, carboxyethyl group, and cyanoethyl group; and the benzene ring of the bonding groups containing a benzene ring contain substituents selected from the group containing of a hydrogen atom, alkyl group, alkoxy group, halogen group, and hydroxyl group, and X represents —O—, —S—,

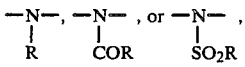

wherein R is the same as defined above, and

D represents a dye or dye precursor.

2. A color photographic light-sensitive material as in claim 1, wherein the reducing group of formula (II) has an oxidation-reduction potential with respect to a saturated calomel electrode of 1.2 V or less in measuring polarographic half wave potential using acetonitrile as a solvent and sodium perchlorate as a support electrolyte.

3. A color photographic light-sensitive material as in claim 1 further comprising a reducing agent.

4. A color photographic light-sensitive material as in claim 1 that is heat-developable.

5. A process for forming an image which comprises image-wise exposing a color photographic light-sensitive material as which comprises at least one 2-acylaminophenol derivative as later defined, heating the thus-exposed photographic light-sensitive material and then transferring a diffusible dye released from the dye-providing 2-acylaminophenol derivative as later defined to an image receiving sheet containing a mordanting agent or a dye receiving base, wherein said color photographic light-sensitive material comprises at least one silver halide emulsion layer and said at least one dye-providing 2-acylaminophenol derivative which is represented by formula (I)

A—L—D (I)

wherein A represents a reducing group represented by the formula (II)

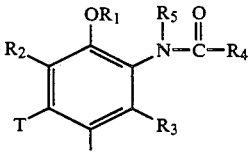

(II)

wherein $R_1$ represents a hydrogen atom or an acyl group, and $R_2$, $R_3$, $R_4$, and $R_5$ each represents a substituent selected from a hydrogen atom, alkyl group, cycloalkyl group, alkenyl group, aryl group, alkoxy group, aryloxy group, aralkyl group, acylamino group, alkylamino group, dialkylamino group, arylamino group, diarylamino group, halogen atom, acyloxy group, hydroxyl group, carboxyl group, cyano group, acyl group, carbamoyl group, substituted carbamoyl group, sulfamoyl group, substituted sulfamoyl group, sulfamoylamino group, substituted sulfamoylamino group, ureido group, substituted ureido group, alkylsulfonyl group, arylsulfonyl group, alkylsulfonylamino group, arylsulfonylamino group and nitro groups, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group, and T represents a substituent selected from alkoxy group, aryloxy group, alkylsulfonylamino group, arylsulfonylamino group, alkylamino group, dialkylamino group, arylamino group and diarylamino group, wherein the alkyl or aryl moieties contain substituents selected from the group consisting of a hydrogen atom, alkoxy group, aryloxy group, acyloxy group, halogen atom, hydroxyl group, carboxyl group, cyano group, acyl group, sulfamoyl group, substituted sulfamoyl group, carbamoyl group, substituted carbamoyl group, acylamino group, ureido group, substituted ureido group, alkylsulfonyl group, arylsulfonyl group, alkylsulfonylamino group, and arylsulfonylamino group;

L represents a bonding group selected from the divalent group

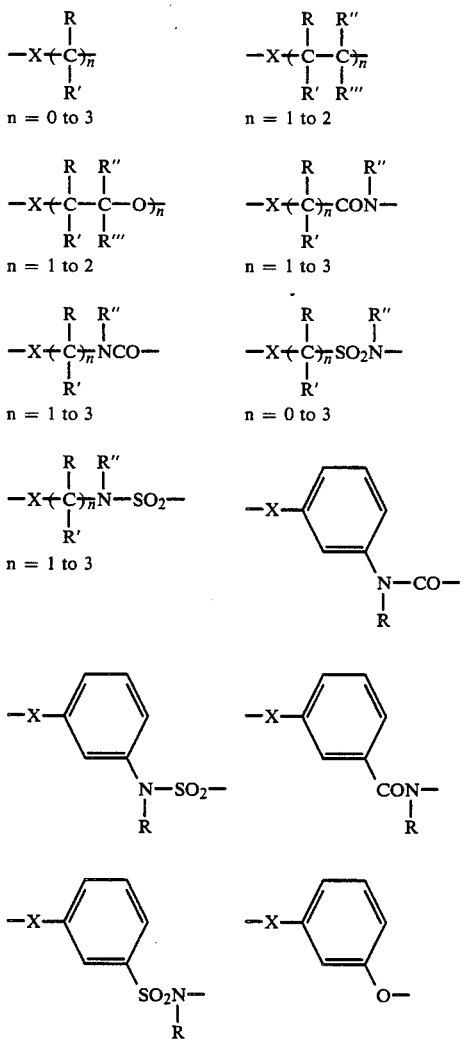

-continued

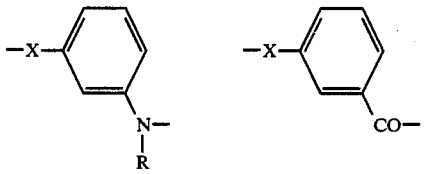

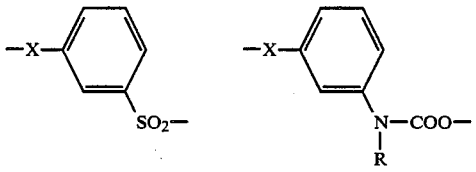

-continued

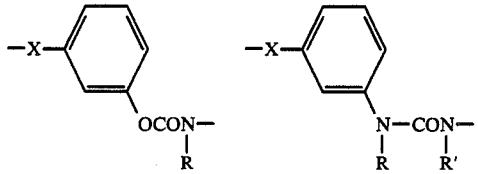

wherein R, R′, R″, and R″ each represents a substituent selected from a hydrogen atom, methyl group, ethyl group, hydroxymethyl group, methoxymethyl group, carboxymethyl group, cyanomethyl group, hydroxyethyl group, methoxyethyl group, carboxyethyl group, and cyanoethyl group; and the benzene ring of the bonding groups containing a benzene ring contain substituents selected from the group containing of a hydrogen atom, alkyl group, alkoxy group, halogen group, and hydroxyl group, and X represents —O—, —S—, $$-\underset{\underset{R}{|}}{N}-,\ -\underset{\underset{COR}{|}}{N}-,\ \text{or}\ -\underset{\underset{SO_2R}{|}}{N}-,$$

wherein R is the same as defined above, and

D represents a dye or dye precursor.

6. A process as in claim 5 wherein the diffusible dye released from the dye-providing 2-acylaminophenol derivative by heating is transferred to the dye receiving base.

* * * * *